US008565658B2

(12) United States Patent
Tsukioka

(10) Patent No.: US 8,565,658 B2
(45) Date of Patent: Oct. 22, 2013

(54) DRIVING APPARATUS, FIXING APPARATUS, AND IMAGE FORMING APPARATUS

(75) Inventor: Yasutada Tsukioka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 13/234,615

(22) Filed: Sep. 16, 2011

(65) Prior Publication Data

US 2012/0070206 A1 Mar. 22, 2012

(30) Foreign Application Priority Data

Sep. 16, 2010 (JP) ..... 2010-208432

(51) Int. Cl.
*G03G 15/20* (2006.01)
*G03G 15/00* (2006.01)

(52) U.S. Cl.
USPC ..... 399/328; 399/67

(58) Field of Classification Search
USPC ..... 399/328, 329, 67, 75, 167, 122, 124
See application file for complete search history.

(56) References Cited

U.S. PATENT DOCUMENTS 8,346,129 B2 * 1/2013 Ukai ..... 399/122
2008/0080910 A1 * 4/2008 Senda et al. ..... 399/328

FOREIGN PATENT DOCUMENTS

JP 9-242843 9/1997
JP 2002-19216 1/2002
JP 2003-48634 2/2003
JP 2010-152280 7/2010

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

A driving apparatus which includes a driving mechanism which includes a moving drive gear, the moving drive gear being a drive gear which is mounted on an axis-moving rotor, the axis-moving rotor being a rotor, the center of which rotor is able to move. The axis-moving rotor is movable over a certain distance in a linear direction. The driving apparatus further includes idler gears connected to the moving drive gear, the idler gears including a fixed idler gear having a fixed axis; and a moving idler gear having a movable axis. The axis of the moving idler gear can oscillate around the axis of the fixed idler gear, and the moving idler gear can move along a periphery direction of the moving drive gear with movement of the moving drive gear.

8 Claims, 7 Drawing Sheets

DRIVING APPARATUS, FIXING APPARATUS, AND IMAGE FORMING APPARATUS

TECHNICAL FIELD

The present invention relates to a driving apparatus used for an image forming apparatus such as a printer, a copying machine, a fax machine, a multi-functional machine, etc.; a fixing apparatus equipped with the driving apparatus; and an image forming apparatus provided with the fixing apparatus.

BACKGROUND ART

For a driving apparatus used for an image forming apparatus such as a printer, a copying machine, a fax machine, a multi-functional machine, etc., a driving apparatus provided with various driving mechanisms for transmitting driving force to a rotor via a gear has been proposed to date.

For example, Patent document 1 discloses a driving mechanism for a photoreceptor drum as follows. In a tandem-type image forming apparatus having four photoreceptor drums yellow, magenta, cyan, and black, referred to respectively as Y, M, C, and K, the photoreceptor drum K is rotationally driven by a drive motor for the photoreceptor drum K, while the photoreceptor drums Y, M, and C are rotationally driven by a color drive motor. The photoreceptor drums Y, M, and C are respectively provided coaxially with a photoreceptor gear; with a gear connected to a rotational axis of the drive motor, driving force is transmitted directly to the photoreceptor gear of the photoreceptor drums Y and M, and is transmitted from the photoreceptor gear of the photoreceptor drum M via an idler gear to the photoreceptor gear of the photoreceptor drum C.

Moreover, Patent document 2 discloses a driving mechanism for a paper-feeding apparatus as follows. In the paper-feeding apparatus used for an image forming apparatus, a paper-feeding roller is rotationally moved around an arm axis of an arm member (a supporting point) so as to be moved, which paper-feeding roller is provided at a tip of the arm member which is supported rotatably according to the height of a loading face of a sheet to be sent out in order to ensure sending out the sheet loaded on a sheet containing unit. Here, rotational driving force of the paper-feeding roller is transmitted from a driving gear coaxially provided with the arm axis onto the arm via multiple idler gears which are respectively provided with rotational axes.

Moreover, representative examples of a driving mechanism which rotationally drives multiple rotors using one drive motor and moves at least one rotor includes what is used in a fixing apparatus for use in an image forming apparatus. A fixing apparatus which includes a fixing roller which is a rotor such that the axial center of the rotor that is rotationally driven by the drive motor does not move, and a pressurizing roller which is a rotor such that the axial center of the rotor moves has been used to date. Here, the object of movably providing the pressurizing roller is to adjust the pressure at which the sheet is held, and a width of a nip portion formed by the fixing roller and the pressurizing roller depending on the type (double sided/single sided, monochrome/full color, etc.) of image formation for forming on a sheet to be fixed onto, the type of the sheet, thickness, etc. In the driving mechanism of the fixing apparatus as described above, it has been common to transmit rotational driving force to the driving gear provided at the pressurizing roller via multiple idler gears and a driving gear provided at the fixing roller.

DISCLOSURE OF THE INVENTION

Then, in the fixing apparatus which moves the pressurizing roller, it is necessary to linearly move the pressurizing roller in order to smoothly transfer the sheet between apparatuses preceding and following the fixing apparatus and to suppress failures such as jamming, etc. This is for the following reason.

The angle of sending into the nip portion and the angle of sending out of the nip portion, that are formed by the sheet onto which fixing is to be conducted using the fixing apparatus with respect to a line segment which connects axial centers of the fixing roller and the pressurizing roller that form the nip portion, become approximately equal. Moreover, the angles of sending out the sheet to the nip portion and sending in the sheet from the nip portion also change depending on the width of the nip portion, the type of the sheet, and the thickness of the sheet; however, the changing occurs due to an increased number of changing factors when the pressurizing roller cannot be moved linearly, or when the line segment which connects the axial centers of the fixing roller and the pressurizing roller veers around the axial center of the fixing roller. The increased number of the changing factors leads to more difficulties in smoothly transferring the sheet between the apparatuses preceding and following the fixing apparatus compared to when the pressurizing roller can be moved linearly. Moreover, the apparatus to handle the above described problem ends up becoming larger, more complex, and more costly, and factors of failure also end up increasing. Moreover, the probability of failures such as jams, etc., occurring ends up increasing. Thus, measures have been taken to date to determine a reference line segment with the axial center of the fixing roller as a base point to move the pressuring roller as linearly as possible along this reference line segment, decrease the number of changing factors, keep the angle of sending out the sheet from the nip portion and the angle of sending in the sheet to the nip portion that are formed by the sheet relative to the reference line segment approximately equal, and smoothly transferring the sheets between the preceding and following apparatuses to suppress failures such as jams, etc.

Moreover, with a more widespread use of the image forming apparatuses in various fields in recent years, there has been an increasing demand for an increased thickness of the sheet onto which an image may be formed. In other words, there has been an increasing demand for widening the linear movement range of the pressurizing roller which forms the nip portion with the fixing roller.

However, the related art driving apparatus of the fixing apparatus, wherein the pressurizing lever rotationally moves the pressurizing roller, requires that the pressurizing roller is moved along a gear pitch circle (below called a reference circle) of idler gears meshed with the pressurizing roller in order to obtain rotational driving force for the driving gear of the pressurizing roller even when the pressurizing roller is moved. When the pressurizing roller is moved along the reference circle of the idler gear which meshes with the pressurizing roller, the locus of the movement ends up becoming arc-shaped. Then, the line segment which connects the axial centers of the fixing roller and the pressurizing roller veers around the axial center of the fixing roller, the angle of sending into the nip portion and the angle of sending out of the nip portion that are formed by the sheet onto which fixing is made with respect to the reference line segment end up changing, and transferring of the sheet between the apparatuses preceding and following the fixing apparatus ends up becoming unstable, leading to a high likelihood of occurrence of failures such as jams, etc. Then, if the linear movement of the pressurizing roller is given priority, and gear driving is conducted such that it deviates somewhat from the reference circle of the idler gear meshed therewith, tooth jumping occurs and the gear driving becomes unstable, so that gear driving can not be ensured.

Moreover, in order to widen the linear movement range of the pressurizing roller, either one of the driving gear of the pressurizing roller and the idler gear which meshes at the reference circle with the driving gear of the pressurizing roller needs to be enlarged to increase the distance from the axial center of the idler gear to the axial center of the driving gear of the pressurizing roller. However, enlarging one of the driving gear and the idler gear of the pressurizing roller leads to enlarging the fixing apparatus.

An example of a driving mechanism such that the pressurizing roller moves in the driving apparatus of the fixing apparatus using a related-art pressurizing lever is described using FIG. 7. FIG. 7 is a diagram which explains movement of the pressurizing roller and the pressurizing lever using a reference circle of a fixing drive gear of the fixing roller, a reference circle of a pressurizing drive gear of the pressurizing roller, and a reference circle of an idler gear of a related-art driving apparatus. In a driving mechanism 200, a fixing drive gear 201 (the fixing roller) and a pressurizing drive gear 202 (the pressurizing roller) are arranged such that the axial center of the pressurizing drive gear 202 is positioned vertically below the axial center of the fixing drive gear 201 when the axial centers of the fixing drive gear 201 and the pressurizing drive gear 202 are moved closest to each other. Then, a line segment which connects the axial centers of the fixing drive gear 201 and the pressurizing drive gear 202 when the axial center of the pressurizing drive gear 202 is positioned vertically below the axial center of the fixing drive gear 201 is set to be a reference line segment. Moreover, an idler gear 203, which meshes with the pressurizing drive gear 202, and an idler gear 204, which meshes with the fixing drive gear 201 and the idler gear 203 are provided in order to transmit, to the pressurizing drive gear 202, rotational driving force which is transmitted from a drive motor on the main body side (not shown) to the fixing drive gear 201. In FIG. 7, for the purpose of explanation, a moving range of the pressurizing drive gear 202 and an arrangement position of a below-described pressing unit 206, etc., are emphasized or simplified, and are positioned to facilitate illustration.

The position in the vertical direction of the axial center of the idler gear 203 which meshes with the pressurizing drive gear 202 is a center of the moving range L in the vertical direction of the pressurizing drive gear 202, and the position in the horizontal direction of the axial center is shown as being β to the right of the axial center of the fixing drive gear 201, which axial center does not move. Moreover, the idler gear 204 is arranged such that it meshes with the fixing drive gear 201 and the idler gear 203. Furthermore, a pressurizing lever 205, which moves the pressurizing drive gear 202, has the right edge shown rotatably held by the axial center of the idler gear 203, rotatably holds the axial center of the pressurizing drive gear 202 to the middle portion, and has the vicinity of the left edge pressed by the pressing unit 206. The pressing unit 206 includes a cam 208 and a spring 207 provided above the left edge of the pressurizing lever 205; the cam 208 and the spring 207 are supported by the apparatus main body; the cam 208 rotates to rotationally move the pressurizing lever 205 around the axial center of the idler gear 203. With the rotational movement of the pressurizing lever 205, the pressurizing drive gear 202, which is held by the pressurizing lever 205, moves in an arc shape.

When the pressurizing drive gear 202 moves in the arc shape, a displacement α in the horizontal direction from the reference line segment takes the maximum value at the center position of the moving range L in the vertical direction of the pressurizing drive gear 202. Here, when the displacement a in the horizontal direction from the reference line segment becomes large, the line segment which connects the axial centers of the fixing roller and the pressurizing roller also veers toward the reference line segment around the axial center of the fixing roller in a manner proportional to the displacement α in the horizontal direction. Then, it becomes not possible to keep the angle of sending in and the angle of sending out that are formed by the sheet onto which fixing is conducted relative to the reference line segment approximately equal. Then, transferring the sheet between the apparatuses preceding and following the fixing apparatus becomes unstable, leading to a high likelihood of occurrence of failures such as jams, etc. Therefore, the displacement a in the horizontal direction is desirably a value which is as small as possible. Moreover, the movement range L in the vertical direction of the pressurizing drive gear 202 also desirably takes a large value in order to respond to a demand for an increased thickness of the sheet onto which image may be formed.

In the configuration of the exemplary driving mechanism, it is necessary to increase the distance in the horizontal direction from the axial center of the fixing roller to the axial center of the idler gear that is to be the center of rotational movement of the pressurizing roller. In other words, one of the pressurizing drive gear 202 and the idler gear 203 has to be enlarged. Then, making the pressurizing drive gear 202 too large causes interference on the fixing drive gear 201 or the axial member, etc., so that the idler gear 203 has to be enlarged. However, it is very difficult to secure space for enlarging the idler gear 203.

In this way, it is difficult to provide a driving apparatus which takes a large moving range of a rotor to be moved, saves space, and ensures gear driving with a feature of rotationally driving multiple rotors with one drive motor and linearly moving at least one rotor.

PATENT DOCUMENT

Patent Document 1 JP2010-152280A
Patent Document 2: JP2003-048634A

In light of the problems as described above, the present invention aims to provide a driving apparatus which takes a moving range of a rotor to be linearly moved that is larger relative to the related art, saves space, and ensures gear driving.

The present invention also aims to provide a fixing apparatus which takes a moving range of a pressurizing member, which is a rotor to be linearly moved that is larger relative to the related art, saves space, and ensures gear driving and an image forming apparatus provided with the fixing apparatus.

According to an embodiment of the present invention, a driving apparatus is provided, including a driving mechanism which includes a moving drive gear, the moving drive gear being a drive gear which is mounted on an axis-moving rotor, the axis-moving rotor being a rotor, the center of which rotor is to move, wherein the axis-moving rotor is movable over a certain distance in a linear direction, the driving apparatus further comprising idler gears connected to the moving drive gear, the idler gears including a fixed idler gear having a fixed axis; and a moving idler gear having a movable axis, wherein the axis of the moving idler gear can oscillate around the axis of the fixed idler gear, and the moving idler gear can move along a periphery direction of the moving drive gear with movement of the moving drive gear.

According to an embodiment of the present invention, a driving apparatus may be provided which takes a moving range of a rotor to be linearly moved that is larger relative to the related art, saves space, and ensures gear driving without enlarging an moving drive gear or an idler gear.

According to an embodiment of the present invention, a fixing apparatus may be provided which may suppress failures such as jams, which takes a moving range of a gear that is larger relative to the related art, saves space, and ensures gear driving by using the driving apparatus, and an image forming apparatus may be provided which includes the fixing apparatus.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Figure 1:
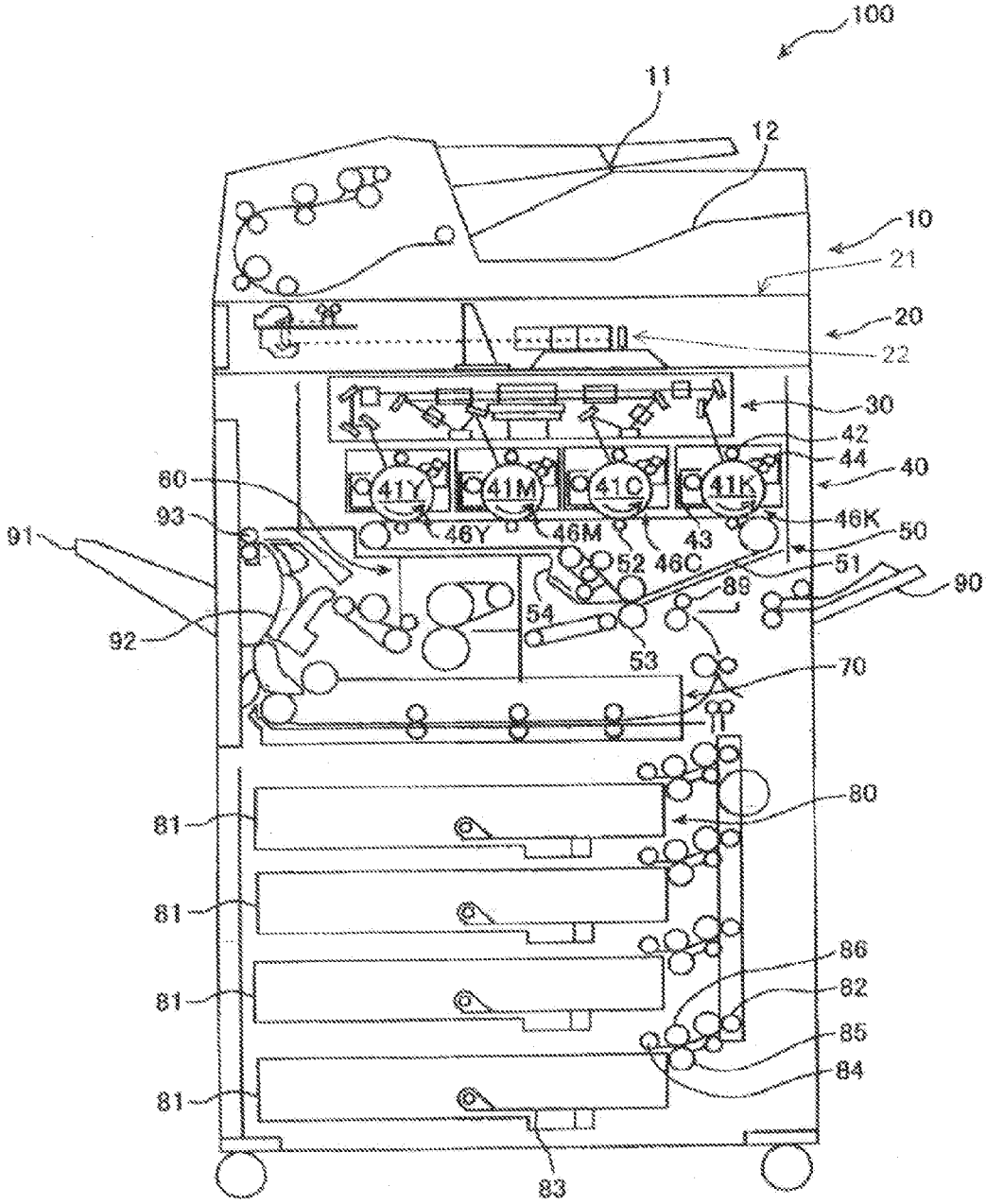
FIG. 1 is an overview diagram of an image forming apparatus according to the present embodiments.
Figure 2:
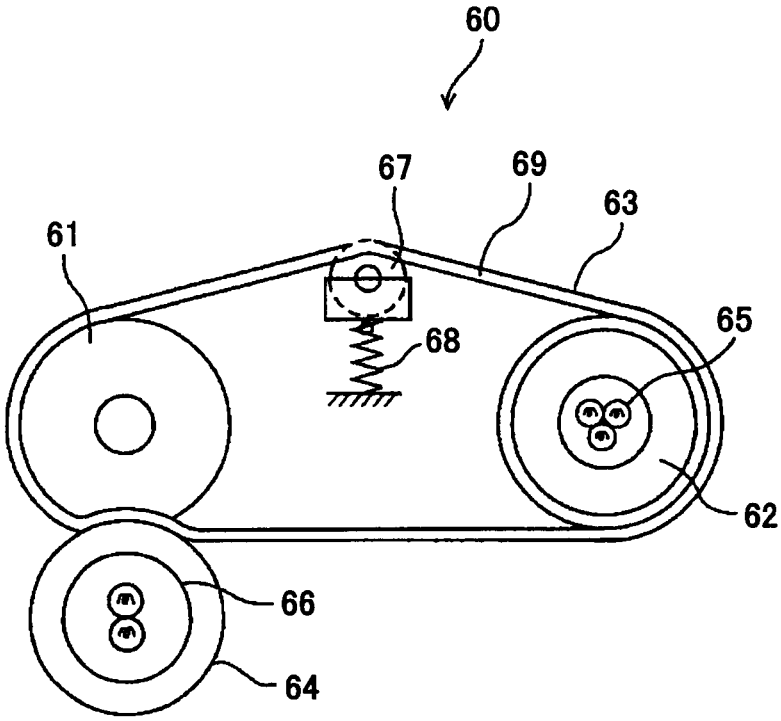
FIG. 2 is a diagram which explains main parts of a fixing apparatus.
Figure 3:
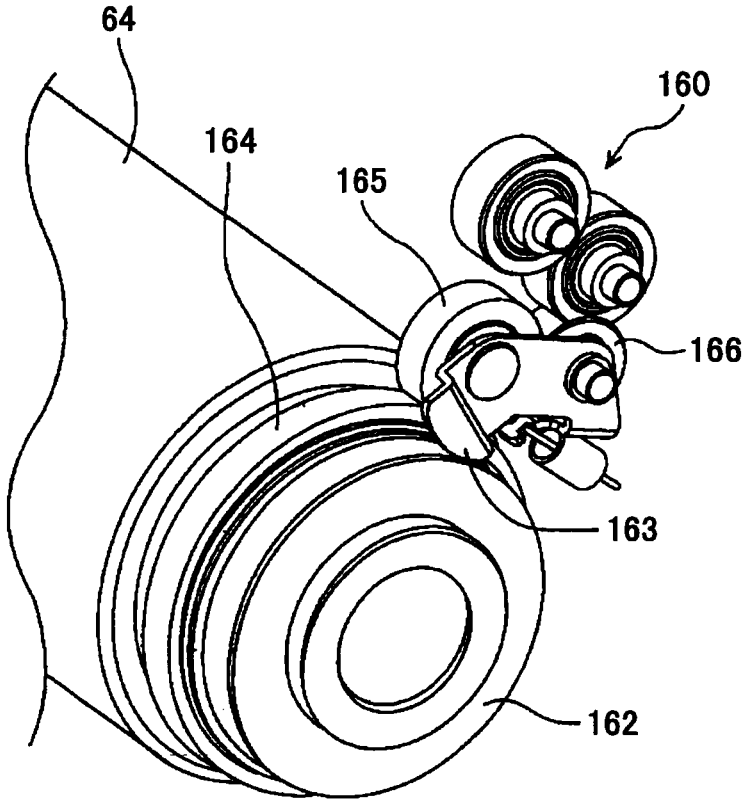
FIG. 3 is a diagram which explains a pressurizing roller and an idler gear which meshes with a driving gear of the pressurizing roller.
Figure 4:
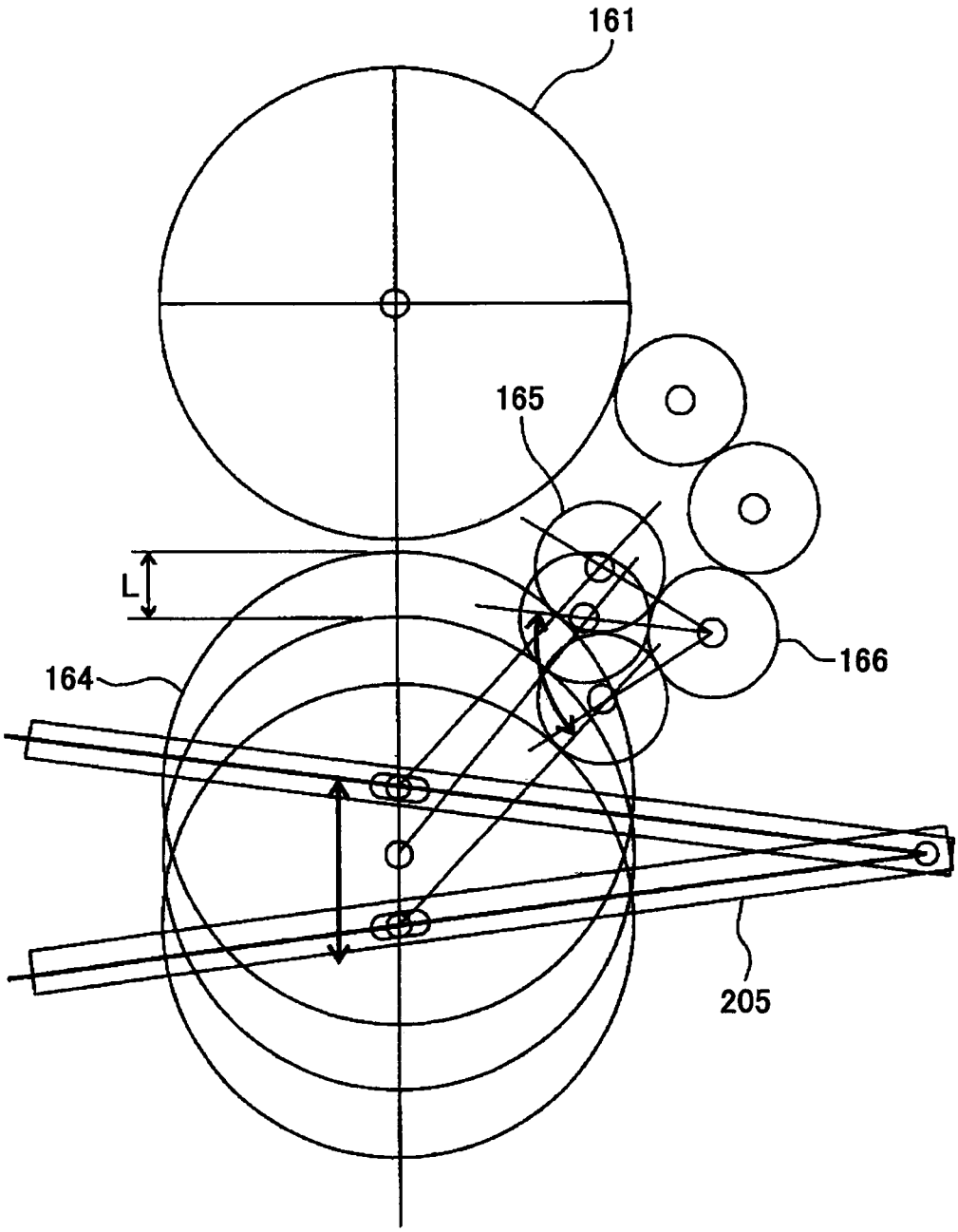
FIG. 4 is a diagram which explains movement of the pressurizing roller and a pressurizing lever using a reference circle of a fixing drive gear of a fixing roller, a reference circle of a pressurizing drive gear of the pressurizing roller, and a reference circle of each of a plurality of idler gears.
Figure 5:
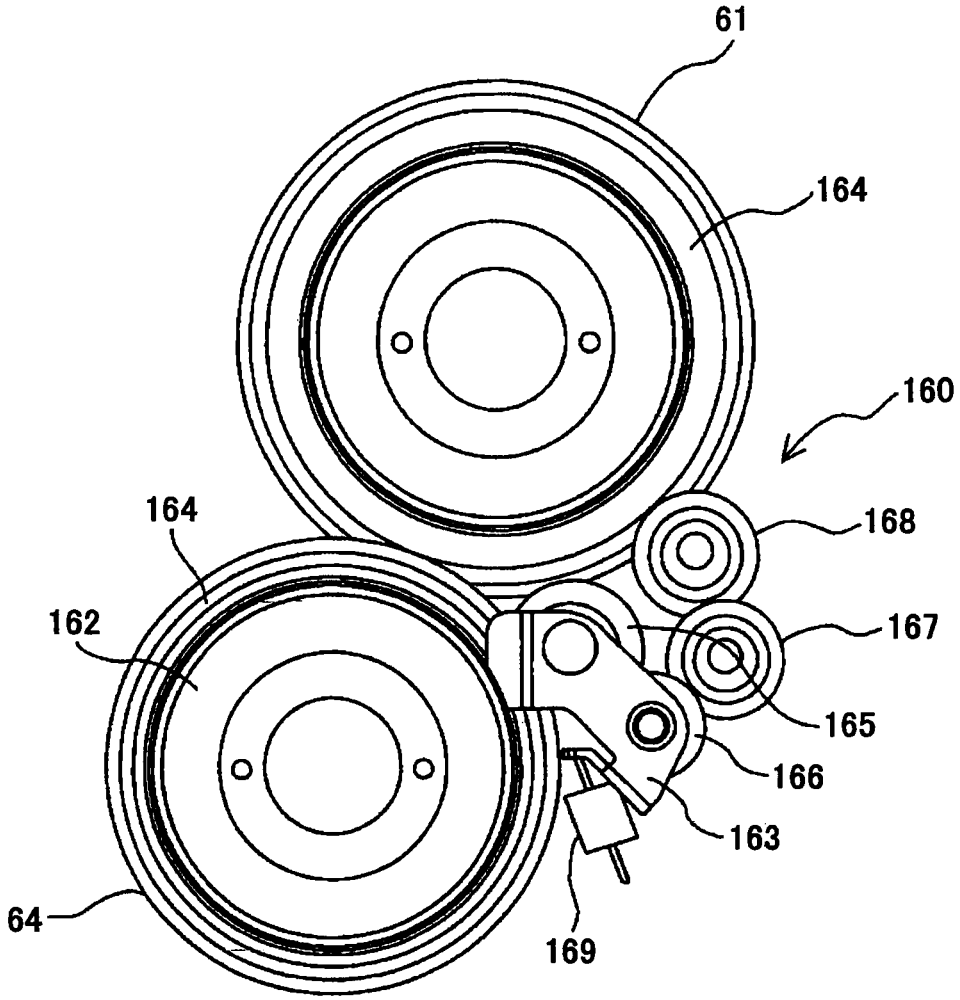
FIG. 5 is a diagram which explains transmission of rotational driving force from the rotationally driven fixing roller to the pressurizing roller.
Figure 6:
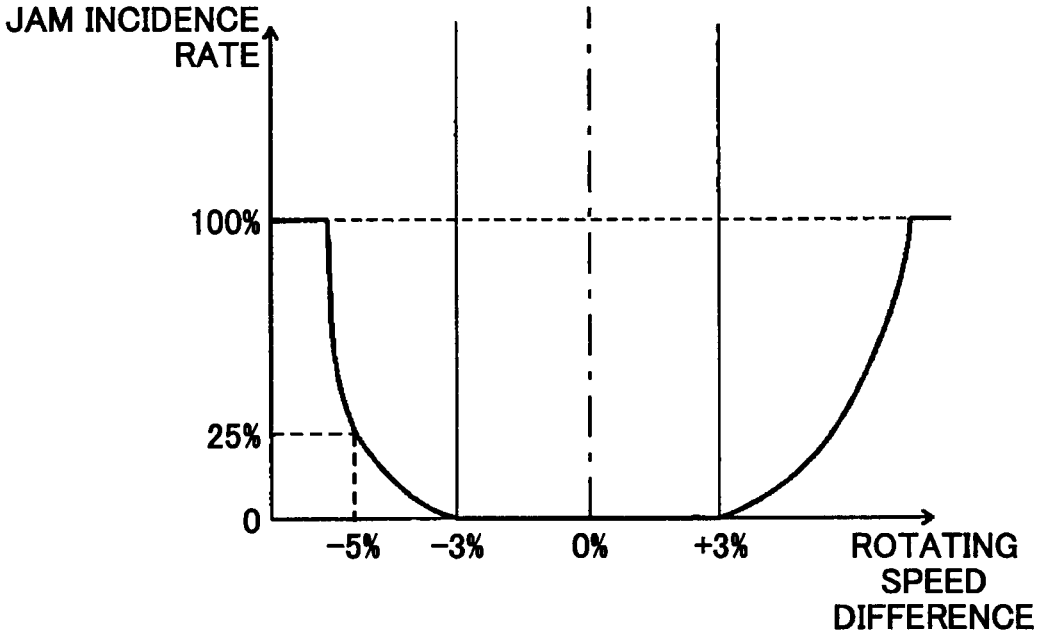
FIG. 6 is a graph showing a relationship between a jam occurrence rate and a rotating speed difference between the fixing roller and the pressurizing roller.
Figure 7:
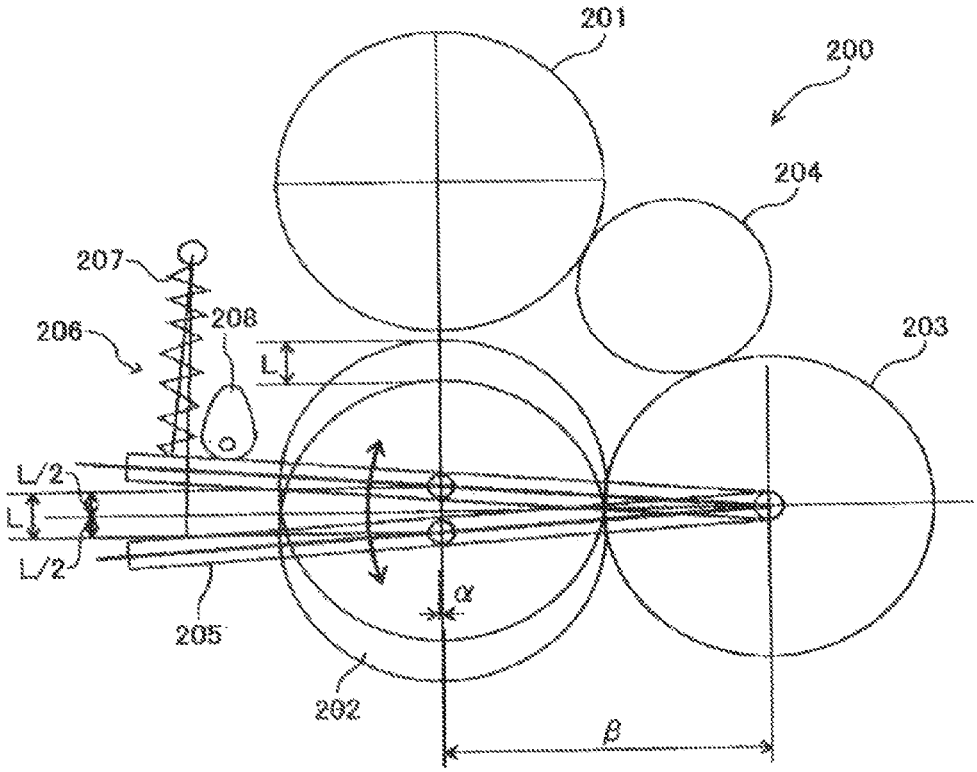
RELATED ART FIG.7
FIG. 7 is a diagram which explains movement of the pressurizing roller and the pressurizing lever using a reference circle of the fixing drive gear of the fixing roller, a reference circle of the pressurizing drive gear of the pressurizing roller, and a reference circle of the idler gear of a related-art driving apparatus.

Below, one embodiment of the present invention that is applied to a driving apparatus of a fixing apparatus provided at a multi-functional machine, which is an electronic photography-type image forming apparatus is described with reference to the drawings. The present embodiment is described with a so-called intermediate-transfer tandem-type full-color image forming apparatus as an example; however it is not limited thereto. Moreover, FIG. 1 is an overview diagram of an image forming apparatus according to the present embodiments; FIG. 2 is a diagram which explains main parts of a fixing apparatus; FIG. 3 is a diagram which explains a pressurizing roller and an idler gear which meshes with a driving gear of the pressurizing roller; FIG. 4 is a diagram which explains movement of the pressurizing roller and a pressurizing lever using a reference circle of a fixing drive gear of a fixing roller, a reference circle of a pressurizing drive gear of the pressurizing roller, and a reference circle of each idler gear; FIG. 5 is a diagram which explains transmission of rotational driving force from the rotationally driven fixing roller to the pressurizing roller; and FIG. 6 is a graph showing a relationship between a jam occurrence rate and a rotating speed difference between the fixing roller and the pressurizing roller.

First, an overview of a multi-functional machine 100 is described using FIG. 1. The multi-functional machine 100 includes an automatic document feeding unit 10; a document reading unit 20; a writing unit 30; an image forming unit 40; a transferring unit 50; a fixing unit 60; a double face unit 70; and a paper supplying unit 80. Moreover, the multi-functional machine 100 is an intermediate transfer tandem-type color multi-functional machine.

The automatic document feeding unit 10 automatically feeds, onto a contact glass 21 of the below-described document reading unit 20, a document (not shown) which is placed at a document supplying section 11; after image information of the document is read with the below-described document reading unit 20, sheets are discharged to a document discharging section 12.

The document reading unit 20 is designed for reading the image information of the document. When a start switch of an operating section (not shown) is operated with a document placed on the contact glass 21 provided at the upper portion of the document reading unit 20, document reading by the document reading unit 20 starts immediately. Moreover, when the start switch is operated with the document being placed on the document supplying section 11 of the automatic document feeding unit 10, a document having an uppermost face of those loaded is automatically fed, after which reading of the document by the document reading unit 20 starts. Upon starting reading by the document reading unit 20, a document placed on the contact glass 21 is photoilluminated by a light source which moves to the right direction shown. Image information is read as an image signal by an image sensor 22 which includes a CCD, etc., for reading a light image reflected from the document.

Based on the signal of image information read by the document reading unit 20, the writing unit 30 photomodulates laser beams for respective colors of Y, M, C, and K, and exposes photoreceptor drums 41 Y, M, C, and K, which are latent image bearing bodies of the below-described image formation unit 40, so as to form an electrostatic latent image.

The image forming unit 40 includes image creating units 46Y, 46M, 46C, and 46K, which correspond to respective colors of Y, M, C, and K. Each image creating unit 46 includes a charging apparatus 42; a developing apparatus 43 which is means for developing; a drum cleaning apparatus 44, etc., around the photoreceptor drum 41, which is a latent-image bearing body. Then, electrostatic latent images on the photoreceptor drums 41 as latent image bearing bodies are developed using corresponding color toners to transform the electrostatic latent images into toner images, then forming the full-color toner image on an intermediate transfer belt 51 of the below-described transferring unit.

The transferring unit 50 includes an intermediate transfer belt; primary transfer rollers 52 corresponding to the four colors, etc.; multiple stretching rollers; a driving roller, etc. Moreover, a transferring apparatus 53 for transferring, onto a sheet which is a body to be recorded on, the full-color toner image formed on the intermediate transfer belt 51 is provided around the intermediate transfer belt 51. Moreover, the transferring unit 50 includes an intermediate transfer cleaning apparatus 54 for removing and recovering toner which remains on a surface of the intermediate transfer belt 51 after the full-color toner image is transferred to a recording body by the transferring apparatus 53; a registration roller 89 for accepting, at a secondary transfer section, a sheet at an appropriate timing; and a conveying unit which conveys the secondary transferred sheet to the below-described fixing unit 60.

As shown in FIG. 2, the fixing unit 60 includes a fixing apparatus which at least includes a pressurizing roller 64, which is a pressurizing roller; a heating roller 62; a fixing roller 61; and a fixing belt 63, which is a fixing member. Moreover, this is also a heating and fixing apparatus which includes an infrared heater 65 within the heating roller 62, and an infrared heater 66 within the pressurizing roller 64, which respective infrared heaters being included as a heating source. In addition, a tension roller 67 is provided which presses upward, from inside, an endless-shaped fixing belt 63 built across the fixing roller 61 and the heating roller to produce a predetermined tension and a spring 68, which presses the tension roller 67 upward via a holding member, is held by a housing of the fixing unit 60. Moreover, a projecting rib section 69 for stopping leaning is formed at an edge of an opening of the endless-shaped fixing belt 63. Then, a full-color toner image formed on a sheet by the transferring unit 50 is pressurized and heated by a fixing nip portion which is formed by a pressurizing roller 64 and a fixing roller 61 via a fixing belt 63, so as to be fixed onto the sheet.

Moreover, the fixing unit 60 includes a driving apparatus (not shown) which rotationally drives a rotor within the unit. The driving apparatus mainly includes a drive motor (not shown) provided on the apparatus main body side; a drive axis (not shown) to which is transmitted the torque from the drive motor; driving gears (not shown) respectively provided coaxially with the fixing roller 61 and the pressurizing roller 64; and an idler gear (not shown) which transmits the torque to these driving gears. Then, the rotational driving force of the drive motor provided on the main apparatus side is transmitted to the driving gear of the fixing roller 61 via the drive axis and the idler gear, etc., to rotationally drive the fixing roller 61, which is a rotor. Here, the drive motor provided on the apparatus main body side may be dedicated to a driving apparatus of the fixing unit 60, or may be shared with other apparatuses.

The rotational driving force, which is transmitted to the fixing roller 61, is transmitted to the fixing belt 63, which is stretched between the fixing roller 61 and the heating roller 62, so that the fixing belt 63 rotates, and the heating roller 62, which is a rotor, is driven by the fixing belt 63 and rotates in conjunction with the rotation of the fixing belt 63. Moreover, the rotational driving force transmitted to the fixing roller 61 is transmitted to the pressurizing roller 64 via a below-described driving mechanism and a nip portion formed by the fixing roller 61 and the pressurizing roller 64 via the fixing belt 63, so that the pressurizing roller 64, which is a rotor, rotates.

Furthermore, while, in the above-described example, a configuration is described which includes an infrared heater as a heating source in each of the heating roller 62 and the pressurizing roller 64, it is not limited thereto, so that any of an IH heater using an IH coil and an IH heater using a planar heating heater, etc., may be used as long as it can heat the nip portion.

The double face unit 70 reverses top and bottom of a sheet, on one side of which is formed and fixed an image. The sheet with the top and the bottom reversed is again conveyed to a secondary transfer section of the transferring unit 50.

The sheet-supplying unit 80 includes four paper-supplying cassettes 81, which are provided in multiple levels, and has multiple sheets loaded on each of the cassettes 81. Moreover, a paper-supplying channel is also provided which includes multiple sets of conveying roller pairs 82. The paper-supplying cassette 81 is provided with a bottom plate 83 which is rotatably supported, on which bottom plate 83 is loaded a bundle of sheets. Moreover, the paper-supplying unit 80 includes a pickup roller 84 which conveys the uppermost sheet of the bundle of sheets on the bottom plate 83; a reverse roller 85 which separates the bundle into individual sheets; and a paper-supplying roller 86 which conveys the separated uppermost individual sheet to a paper-supplying channel. Then, a registration roller 89 is provided downstream of the paper-supplying channel.

Moreover, on the right hand side of the multi-functional machine 100 is provided a manual tray 90 which makes it possible to load the sheets thereon to supply them to the registration roller 89 of the transferring unit 50. Then, on the left hand side of the multi-functional machine 100 is provided a discharged-sheet loading tray 91, on which is loaded sheets discharged from a paper discharge outlet by rotation of the paper discharging roller 93. Moreover, between the paper discharge outlet and the fixing unit 60 is provided a branching section 92 which branches sheets to be guided to the paper discharge outlet side and sheets to be guided to the double face unit 70.

Next, an image creating process of the multi-functional machine 100 is described. As shown in FIG. 1, in the corresponding image creating units 46 of the image forming unit 40, toner images of four colors are formed at a certain timing on the photoreceptor drums 41 in alignment with rotation of the intermediate transfer belt 51 by a well-known electronic photography process. First, in the image creating unit 46Y, a yellow toner image which is formed on the leftmost photoreceptor is transferred to the intermediate transfer belt 51. In the image creating unit 46M, a magenta toner image which is formed on the next photoreceptor is superposed onto the yellow toner image so as to be transferred to the intermediate transfer belt 51. In the image creating unit 46C, a cyan toner image which is formed on the next photoreceptor is superposed onto the magenta toner image so as to be transferred to the intermediate transfer belt 51. In the black image creating section 46K, a black toner image which is formed on the rightmost photoreceptor is superposed onto the cyan toner image so as to be transferred to the intermediate transfer belt 51. In this way, toner images of four colors that are formed on the corresponding photoreceptors are successively superposed so as to be transferred, forming a full-color toner image on the intermediate transfer belt 51.

On the other hand, in parallel with an image forming operation of forming a full-color toner image onto the intermediate transfer belt 51, sheets from a selected paper-supplying cassette 81 of the paper-supplying unit 80 are successively separated and supplied one by one. Here, a bundle of sheets is loaded on the bottom plate 83 which is rotatably supported to the paper-supplying unit 81. The rotational movement of the bottom plate 83 raises the uppermost sheet of the bundle of sheets to a position at which it can abut against the pickup roller 84. The uppermost sheet is supplied by rotation of the pick-up roller 84 to be separated into individual sheets by the reverse roller 85. Then, by rotation of the paper-supplying roller 86, the separated uppermost individual sheet is sent from the paper-supplying cassette 81 to the registration roller 89 which is arranged downstream of the conveying channel.

The thus separated sheet conveyed faces the nip of the registration roller 89, so it ends up standing by with the conveying being stopped temporarily. The registration roller 89 is controlled so that it starts rotating with a certain timing such that a positional relationship between a tip of the sheet and a full-color toner image formed on the intermediate transfer belt 51 meets a predetermined positional relationship. The sheet standing by is conveyed again with the rotation of the registration roller 89. In this way, the full-color toner image which is formed on the intermediate transfer belt 51 by the transfer apparatus 53 is transferred to the predetermined position of this sheet.

In this way, the sheet onto which the full-color toner image is transferred is sent into a fixing unit 60, which is fixing means downstream of the conveying channel. The fixing unit 60 fixes onto the sheet the full-color toner image transferred by the transferring apparatus 53. The sheet onto which the full-color toner image is fixed is discharged to and loaded on the discharged-sheet loading tray 91 by rotation of the paper-discharging roller 93. Here, when image is formed on both faces of the sheet, the conveying channel of the fixed sheet is switched by the branching section 92 and the sheet is made to go through the double face unit 70 to reverse the front and back faces. In a manner similar to the image formation on one face as described above, the sheet with the front and back faces reversed undergoes image formation onto the back face.

Next, an exemplary driving mechanism which is provided by an driving apparatus for use in the fixing unit 60, which is a fixing apparatus, is described, according to embodiments and using the drawings.

Embodiment 1

First, an embodiment 1 which is a first embodiment is described using FIG. 3. A driving mechanism 160 of the present embodiment is characterized by the feature that rotational driving force which is transmitted to an idler gear B 166 via multiple idler gears and a driving axis from a drive motor provided on the apparatus main body side is transmitted to a pressurizing drive gear 164 which is provided at a pressurizing roller 64 via an idler gear A 165. Therefore, the following explanation is provided with respect to the feature that the rotational driving force of the idler gear B 166 being rotationally driven is transmitted to the pressurizing drive gear 164 via the idler gear A 165, rotationally driving the pressurizing roller 64, so that explanations of the other features of the driving mechanism are omitted when not needed.

As shown in FIG. 3, the driving mechanism 160 mainly includes the pressurizing drive gear 164 of the pressurizing roller 64, the idler gear A 165, and the idler gear B 166. Moreover, it includes a member (below called a circular-shaped pressurizing member 162), a perimeter of which a side face parallel to the axial center has a circular-shaped section; and a member (below called an idler circular-shaped member 163) which includes a circular-shaped section coaxially provided with the idler gear A 165.

Here, as shown in FIG. 3, the pressurizing drive gear 164 of the pressurizing roller 64 is provided with an m=1, Z69 gear, while the idler gear A 165 which meshes with the pressurizing drive gear 164 is provided with an m=1, Z22 gear. Moreover, as the member which includes the circular-shaped section, a ball bearing ϕ62 is used as a pressurizing circular-shaped member 162 for the pressurizing roller 64, while the idler circular-shaped member 163 which includes a circular-shaped section of ϕ29 around the axial center of the idler gear A 165 is used. In this way, the sum of radial distances of the circular-shaped section of the idler circular-shaped member 163 and the pressurizing circular-shaped member 162 is set to take the same value as the sum of radial distances of reference circles of the pressurizing drive gear 164 and the idler gear A 165. The respective idler gears used for the driving mechanism of the present embodiment all use single gears with m=1.

Moreover, the idler circular-shaped member 163 is held by an axial center of an idler gear A 165 and an axial center of an idler gear B 166 which meshes with the idler gear A 165. Furthermore, the idler gear B 166 meshes with the idler gear A165, so that rotational driving force of the idler gear B 166 is transmitted, driving the idler gear A 165. Then, the circular-shaped section of the idler circular-shaped member 163, which is formed such that it is in contact with a ball bearing end face of the rotating pressurizing circular-shaped member 162 on a straight line which connects axial centers of the pressurizing drive gear 164 and the idler gear A 165 and such that it moves with a movement of the pressurizing roller 64, includes arc-shaped portions arranged. The thus formed and arranged idler circular-shaped member 163 is in contact with a ball bearing end face of the pressurizing circular-shaped member 162, causing the pressurizing drive gear 164 and the idler gear A 165 to mesh together at a reference circle, so that rotational driving force of the idler gear A 165 is transmitted, driving the pressurizing drive gear 164. Then, the idler circular-shaped member 163 is rotationally movable around an axial center of the idler gear B 166, so that, even when the pressurizing roller 64 moves a certain distance, the gears themselves may mesh together and drive at a reference circle while moving along the contact points with the ball bearing end face of the pressurizing circular-shaped member 162.

Here, a case such that the pressurizing roller 64 moves a certain distance in a straight line is more specifically explained using FIG. 4. Here, FIG. 4 explains movement of the pressurizing roller 64 and a pressurizing lever 205 using a reference circle of a fixing drive gear of a fixing roller 61, a reference circle of the pressurizing drive gear 164 of the pressurizing roller 64, and a reference circle of each idler gear. Moreover, for the purpose of explanations, the feature is explained of vertically arranging the axial center of the fixing drive gear 161 (fixing roller 61) and the axial center of the pressurizing drive gear 164 (pressurizing roller 64) in the upper and lower portions, but it is not limited to the feature as described above. As shown in FIG. 4, the driving mechanism of the present embodiment differs from the related art driving mechanism such that it is not necessary to keep uniform a distance from a center of rotational movement of the pressurizing lever 205 which moves the pressurizing drive gear 164 to an axial center of the pressurizing roller 64. Moreover, it is not necessary to set the center of rotational movement of the pressurizing lever 205 as an axial center of the idler gear A 165.

Thus, at the fixing unit 60 of the present embodiment, a loose hole (not shown), etc., may be provided in the lever axis direction at a portion of the pressurizing lever 205 which holds an axial center of the pressurizing drive gear 164, providing a guide member (not shown) which guides, in the vertical direction, the axial center of the pressurizing drive gear 164 on the fixing unit 60 side. In this way, the pressurizing drive gear 164 may be moved in the vertical direction (straight-line direction) over a certain distance, so that the moving range of the pressurizing driving gear 164 is not constrained due to the pressurizing drive gear 164 moving such that it draws an arc-shaped locus as in the related-art cases. Moreover, as shown in FIG. 4, the driving mechanism of the present embodiment makes it possible to rotationally move the idler gear A 165 around the axial center of the idler gear B 166 with the pressurizing drive gear 164 and the idler gear A 165 being meshed together in a reference circle.

Thus, the driving mechanism of the present invention makes it possible to take a moving range of the pressurizing roller 64 that is larger than the related-art driving mechanisms, while being able to ensure transmission of rotational driving force without having to enlarge the idler gear A 165 as in the related art. Moreover, while a member having the above-described shape is adopted as a member having a circular-shaped section in the present embodiment, a flange face of a reference circle may be formed on respective end faces of each of the gears, for example. Moreover, in the present embodiment, a transmission mechanism is explained such that rotational driving force transmitted from the fixing drive gear 161 of the fixing roller 61 is transmitted to the idler gear A 165 via an idler gear D 168, an idler gear C 167, and the idler gear B 166; and the rotational driving force transmitted to the idler gear A 165 is transmitted to the pressurizing drive gear 164, rotationally driving the pressurizing roller 64. However, this is not limited hereto, so that, for example, rotational driving force is transmitted to the idler gear B 166 via a driving axis and multiple idler gears from a drive motor provided on the apparatus main body side, the driving force transmitted to the idler gear B 166 is transmitted to the idler gear A 165, and the rotational driving force transmitted to the idler gear A 165 is transmitted to the pressurizing drive gear 164, rotationally driving the pressurizing roller 64.

Embodiment 2

Next, an embodiment 2 which is a second embodiment is described using FIG. 5. The above described feature of the driving mechanism of the embodiment 1 is such that rotational driving force transmitted to the idler gear B 166 is transmitted to the pressurizing driving gear 164 provided at the pressurizing roller 64 via the idler gear A 165. On the other hand, the driving mechanism 160 of the present embodiment is different therefrom in that, added to the feature of embodiment 1 is the feature that a one-way gear is provided at the pressurizing drive gear 164 to set whether rotational driving force transmitted to the fixing roller 61 is transmitted to the pressurizing roller 64 via a fixing nip portion or via the pressurizing drive gear 164. Thus, in the explanations below, features and operational advantages that are common to the embodiment 1 are omitted when not needed.

The diameter of the fixing roller 61 is ϕ90, the diameter of the pressurizing roller 64 is ϕ80, while m=1, Z81 is used for the fixing drive gear 161 and m=1, Z69 is used for the pressurizing drive gear 164. Then, the above-described gears are coupled by the idler gears A 165, B 166, C 167, and D 168. Moreover, in a manner similar to embodiment 1, coupling of the pressurizing drive gear 164 and the idler gear A 165 is such that the circular-shaped idler member 163 and a ball bearing, which is the circular-shaped pressurizing member 162, are made to contact each other and driven by making them mesh together in a reference circle.

In the driving mechanism of the embodiments of the present invention, rotational driving force is transmitted by the fixing drive gear 161 which is rotationally driven by a drive motor provided on the apparatus main body side, so that it is rotated. However, a nip portion is formed by the fixing roller 61 and the pressurizing roller 64 via the fixing belt 63, so that rotational driving force of the fixing roller 61 is transmitted to the pressurizing roller 64 also via the nip portion. Therefore, the rotating speed of the pressurizing roller 64 does not become constant relative to the rotating speed (speed in the peripheral direction) of the fixing roller 61 due to the nip width or expansion by heat of the rollers. In the pressurizing roller 64, difference of rotating speed by gear couplings with rotating speed by the nip portion occurs, causing slipping at the nip portion or tooth jumping of the gears.

Then, in the driving mechanism 160 of the present embodiment, the pressurizing drive gear 164 is provided with a one-way clutch. When rotating speed (below-called nip drive rotating speed) of the pressurizing roller 64 which is rotationally driven via a nip portion with the fixing roller 61 through which the fixing belt 63 is built is faster than rotating speed (below-called gear drive rotating speed) of the pressurizing roller 64 which is rotationally driven via idler gears (A, B, C, D) and the fixing drive gear 161 from the fixing roller 61, the pressurizing drive gear 164 remains idle. Then, when the nip drive rotating speed of the pressurizing roller 64 is slower than the gear drive rotating speed of the pressurizing roller 64, it is set for gear driving to be conducted. Either rotating speed is speed in the peripheral direction.

With such a configuration as described above, the pressurizing roller 64 rotates in association with the fixing roller 61 as the gear driving is not conducted unless the pressurizing roller 64 slips relative to the fixing roller 61. Therefore, driving gears of the fixing roller 61 and the pressurizing roller 64 that are coupled via idler gears (A, B, C, and D) smoothly rotate, so that the gear driving may be conducted as needed, making it possible to ensure the gear driving. The idling torque occurs at the one-way gear when it remains idle, which idling torque brings the idler gear A 165 toward the state such that tooth jumping occurs. Thus, in the present embodiment, the circular-shaped idler member 163 is provided with an energizing unit 169, so that the idler gear A165 is energized toward the pressurizing drive gear 164 so as to deal with the generated idling torque which brings the idler gear A 165 toward the state such that tooth jumping occurs.

Moreover, the present inventor has studied the relationship between the occurrence rate of jams in the fixing unit 60 and the rotating speed difference between the rotating speed (line speed of the center of the nip portion) of the fixing belt 63, which is a fixing member built to the fixing roller 61, and the rotating speed (line speed) of the pressurizing roller 64 and obtained the study results as shown in FIG. 6. As evident from the graph of FIG. 6, when the rotating speed of the pressurizing roller 64 becomes slower and the difference with the rotational speed of the fixing belt 63, which is a fixing member built to the fixing roller 61, becomes no greater than −3.0% and when the rotating speed of the pressurizing roller 64 becomes faster and the difference with the rotational speed of the fixing roller 61 becomes no less than +3.0%, the occurrence rate of the jam becomes higher. The following equation is used as an equation to calculate the rotating speed difference:

$$\text{Rotating speed difference \%} = (\text{nip drive rotating speed of the pressurizing roller 64} - \text{rotating speed of the fixing belt 63 built to the fixing roller 61}) \times 100 / \text{rotating speed of the fixing roller 61} \quad (1)$$

Here, in the fixing apparatus which forms a nip portion by the pressurizing roller 64 and the fixing roller 61 via the fixing belt 63, which is a fixing member, there is a tendency for the nip drive rotating speed of the pressurizing roller 64 which rotates in association via the nip portion to become slower relative to the fixing belt 63, the narrower the nip width. Then, in the present embodiment, the above-described feature is provided for ensuring gear driving when the rotating speed difference between the pressurizing roller 64 and the fixing roller 61 becomes no more than −3.0% at a width of the nip portion such that the nip drive rotating speed of the pressurizing roller 64 which rotates in association via the nip portion becomes slowest, or the narrowest nip width. In other words, radii of the fixing roller 61 and the pressurizing roller 64, and m, Z of respective gears are set for conducting gear driving of the pressurizing roller 64 at the gear drive rotating speed (rotating speed on the safety side) which is slightly faster than the rotating speed of −3.0% of the rotating speed (line speed) of the fixing belt 63.

In this way, when the rotating speed of the pressurizing roller 64 which rotates in association via the nip portion becomes 3% slower relative to the rotating speed of the fixing belt 63, which is a fixing member built to the fixing roller 61, gear driving is ensured to avoid damaging the image-formed sheet to which fixing is to be conducted. Moreover, an image forming apparatus may be provided which makes it possible to contain damage to the pressurizing roller 64 to the minimum, and to ensure gear driving even when a gear movement is made which is larger relative to the related art.

Thus, the driving apparatus provided with the driving mechanism 160 of the present embodiment makes it possible to also move the idler gear A 165 in order for the idler gear A 165 and the pressurizing drive gear 164 that move linearly to mesh together. Then, the pressurizing drive gear 164 and the idler gear A 165 are arranged to respectively hold a member which includes a circular-shaped section in order for them to mesh together at respective reference circles with the sum of radii of the respective circular-shaped sections and the sum of radii of reference circles of the pressurizing drive gear 164 and the idler gear A 165 to take the same value. The sum of radii of the respective circular-shaped sections and the sum of radii of reference circles of the moving drive gear 164 and the idler gear 165 take the same value, so that the respective circular-shaped sections may be pushed against each other to ensure meshing together at the reference circles. Therefore, unlike the related-art features, it is not necessary to make the center of rotational movement of the pressurizing lever 205 which holds the pressurizing drive gear 164 be the axial center of the idler gear A 165. Thus, a loose hole, etc., may be provided at a portion which holds the pressurizing drive gear 164 of the pressurizing lever 205 to linearly move the pressurizing drive gear 164, so that there is no need to enlarge the pressurizing drive gear 164 or the idler gear A 165. Thus, a moving range of the pressurizing drive gear 164 to be moved linearly may be set larger than in the related art, ensuring gear driving between the pressurizing drive gear 164 and the idler gear A 165.

Moreover, the driving apparatus which is provided with the driving mechanism 160 of the present embodiment has the pressurizing drive gear 164 provided with a one-way gear, which one-way gear remains idle when the nip drive rotating speed of the pressurizing roller 64 which is rotated by the fixing roller 61 via the nip portion is faster than the gear drive rotating speed of the pressurizing roller 64 for gear driving. Then, when the nip drive rotating speed of the pressurizing roller 64 becomes slower than the gear drive rotating speed of the pressurizing roller 64, the gear is set to be driven. Therefore, driving gears of the fixing roller 61 and the pressurizing roller 64 which are coupled via idler gears (A, B, C, and D) smoothly rotate, so that the gear driving may be conducted as need, thus making it possible to ensure gear driving.

Moreover, the fixing unit 60, which is a fixing apparatus of the present invention, is provided with the above-described driving apparatus, so that gear driving with space savings is ensured even when gear movement is larger relative to the related art. Moreover, in the fixing unit 60, which is a fixing apparatus of the present embodiment, the above-described drive apparatus is provided, so that driving gears of the fixing roller 61 and the pressurizing roller 64 which are coupled via idler gears (A, B, C, and D) smoothly rotate, so that the gear driving may be conducted as needed. Thus, gear driving with space savings is ensured even when gear movement is larger relative to the related art.

Moreover, the multi-functional machine 100, which is an image forming apparatus, is provided with the above-described fixing apparatus, so that gear driving with space savings is ensured even when gear movement is larger relative to the related art. Moreover, in the multi-functional machine 100, which is an image forming apparatus of the present embodiment, when the nip drive rotating speed of the pressurizing roller 64 becomes 3% slower relative to the rotating speed of the fixing belt 63, which is a fixing member built to the fixing roller 61, switching to gear driving is ensured to avoid damaging the sheet to which fixing is to be conducted and also to minimize damaging the pressurizing roller 64. Thus, gear driving with space savings is ensured even when gear movement is larger relative to the related art.

The present application is based on Japanese Priority Application No. 2010-208432 filed on Sep. 16, 2010, the entire contents of which are hereby incorporated by reference.

The invention claimed is:

1. A driving apparatus comprising a driving mechanism which includes a moving drive gear, the moving drive gear being a drive gear which is mounted on an axis-moving rotor, a center of which axis-moving rotor is able to move, wherein the axis-moving rotor is movable over a certain distance in a linear direction, the driving apparatus further comprising idler gears connected to the moving drive gear, the idler gears including a fixed idler gear having a fixed axis; and a moving idler gear having a movable axis, wherein the axis of the moving idler gear can oscillate around the fixed axis of the fixed idler gear, wherein the moving idler gear can move along a periphery direction of the moving drive gear with movement of the moving drive gear, the driving apparatus further comprising an energizing section which energizes the moving idler gear to the moving drive gear.

2. The driving apparatus as claimed in claim 1, wherein an interpitch distance between the moving drive gear and the moving idler gear is determined by respective circular-shaped sections of members pushing against each other, each of the members having the circular-shaped section.

3. A fixing apparatus, comprising at least the driving apparatus as claimed in claim 1, a fixing member, and a pressurizing member, wherein the axially-moving rotor is a pressurizing roller, which is a pressurizing member, and a direction in which an energizing unit energizes the moving idler gear is a direction in which the pressurizing roller leaves a fixing roller.

4. An image forming apparatus, comprising the fixing apparatus as claimed in claim 3.

5. A driving apparatus comprising a driving mechanism which includes a moving drive gear, the moving drive gear being a drive gear which is mounted on an axis-moving rotor, a center of which axis-moving rotor is able to move, wherein the axis-moving rotor is movable over a certain distance in a linear direction, the driving apparatus further comprising idler gears connected to the moving drive gear, the idler gears including a fixed idler gear having a fixed axis; and a moving idler gear having a movable axis, wherein the axis of the moving idler gear can oscillate around the fixed axis of the fixed idler gear, wherein the moving idler gear can move along a periphery direction of the moving drive gear with movement of the moving drive gear, wherein the moving drive gear and the moving idler gear respectively hold, at the gear or at an axial member of the gear, members having a circular-shaped section coaxially provided with the respective gears, and a sum of a radius of the circular-shaped section of the moving drive gear and a radius of the circular-shaped section of the moving idler gear take the same value as a sum of radii of a gear pitch circle of the moving drive gear and a gear pitch circle of the moving idler gear.

6. A driving apparatus comprising a driving mechanism which includes a moving drive gear, the moving drive gear being a drive gear which is mounted on an axis-moving rotor, a center of which axis-moving rotor is able to move, wherein the axis-moving rotor is movable over a certain distance in a linear direction, the driving apparatus further comprising idler gears connected to the moving drive gear, the idler gears including a fixed idler gear having a fixed axis; and a moving idler gear having a movable axis, wherein the axis of the moving idler gear can oscillate around the fixed axis of the fixed idler gear, wherein the moving idler gear can move along a periphery direction of the moving drive gear with movement of the moving drive gear, wherein the driving mechanism includes a fixed driving gear mounted on an axially-fixed rotor, an axial center of which axially-fixed rotor does not move; the multiple idler gears; and the moving drive gear mounted on the axis-moving rotor, wherein the driving mechanism is able to transmit rotational driving force of the axially-fixed rotor to be rotationally driven to the moving drive gear via the multiple idler gears and to gear drive the axis-moving rotor, the axially-fixed rotor and the axis-moving rotor forming a nip portion, the axially-moving rotor being also rotationally driven via the nip portion, and wherein the moving drive gear, which is a one-way gear, remains idle when a rotating speed of the axis-moving rotor which is rotationally driven via the nip portion is faster than the rotating speed of the gear driven axis-moving rotor, and is driven when the rotating speed of the axis-moving rotor which is rotationally driven via the nip portion is slower.

7. A fixing apparatus, comprising at least the driving apparatus as claimed in claim 6, a fixing member, and a pressurizing member, wherein the axis-moving rotor is a pressurizing roller; and the axially-fixed rotor is a fixing roller, which is a fixing member, or a fixing roller which rotates the fixing member.

8. The fixing apparatus as claimed in claim 7, wherein gear driving is performed when a rotating speed of the pressurizing member is 3% slower relative to a rotating speed of the fixing member.

* * * * *